US006336789B1

(12) United States Patent
Beerens et al.

(10) Patent No.: US 6,336,789 B1
(45) Date of Patent: Jan. 8, 2002

(54) CASING FOR A STEAM OR GAS TURBINE

(75) Inventors: Christoph Beerens, Dogern (DE); Josef Huster, Mellingen (CH)

(73) Assignee: ABB Alstom Power (Schweiz) AG, Baden (CH)

( * ) Notice: Subject to any disclaimer, the term of this patent is extended or adjusted under 35 U.S.C. 154(b) by 0 days.

(21) Appl. No.: 09/482,082

(22) Filed: Jan. 13, 2000

(30) Foreign Application Priority Data

Jan. 20, 1999 (EP) ..... 99810037

(51) Int. Cl.[7] ..... F04D 1/00
(52) U.S. Cl. ..... 415/182.1
(58) Field of Search ..... 415/182.1

(56) References Cited

U.S. PATENT DOCUMENTS

| | | | | |
|---|---|---|---|---|
| 4,551,065 A | | 11/1985 | Becker | |
| 4,900,222 A | * | 2/1990 | Meng et al. | 415/182.1 |
| 5,605,438 A | * | 2/1997 | Burdgick et al. | 415/182.1 |

FOREIGN PATENT DOCUMENTS

| | | | |
|---|---|---|---|
| DE | 19544011 A1 | 5/1997 | |
| DE | 19806809 C1 | 3/1999 | |
| GB | 2034825 A | 6/1980 | |
| GB | 2035152 A | 6/1980 | |

* cited by examiner

*Primary Examiner*—John Kwon
(74) *Attorney, Agent, or Firm*—Burns, Doane, Swecker & Mathis, L.L.P.

(57) ABSTRACT

A casing for a steam or gas turbine comprises a shell and two flanges. The wall thickness of the shell is varied in an upper region facing away from the flange, in two central regions and in two lower regions facing the flanges, such that the upper region facing away from the flanges is reinforced in comparison with the lower regions facing the flanges. The lower regions facing the flanges are more flexible than the flanges which are attached by screws, and the partially reinforced central region and the reinforced upper region, and act as a joint to compensate for deformation, particularly in the radial direction. Consequently, the casing remains considerably more round in operation. The reduced radial clearance (achieved by reduced deformation) between the casing and the ends of the turbine blades leads to considerably increased efficiency during operation of the turbine.

4 Claims, 1 Drawing Sheet

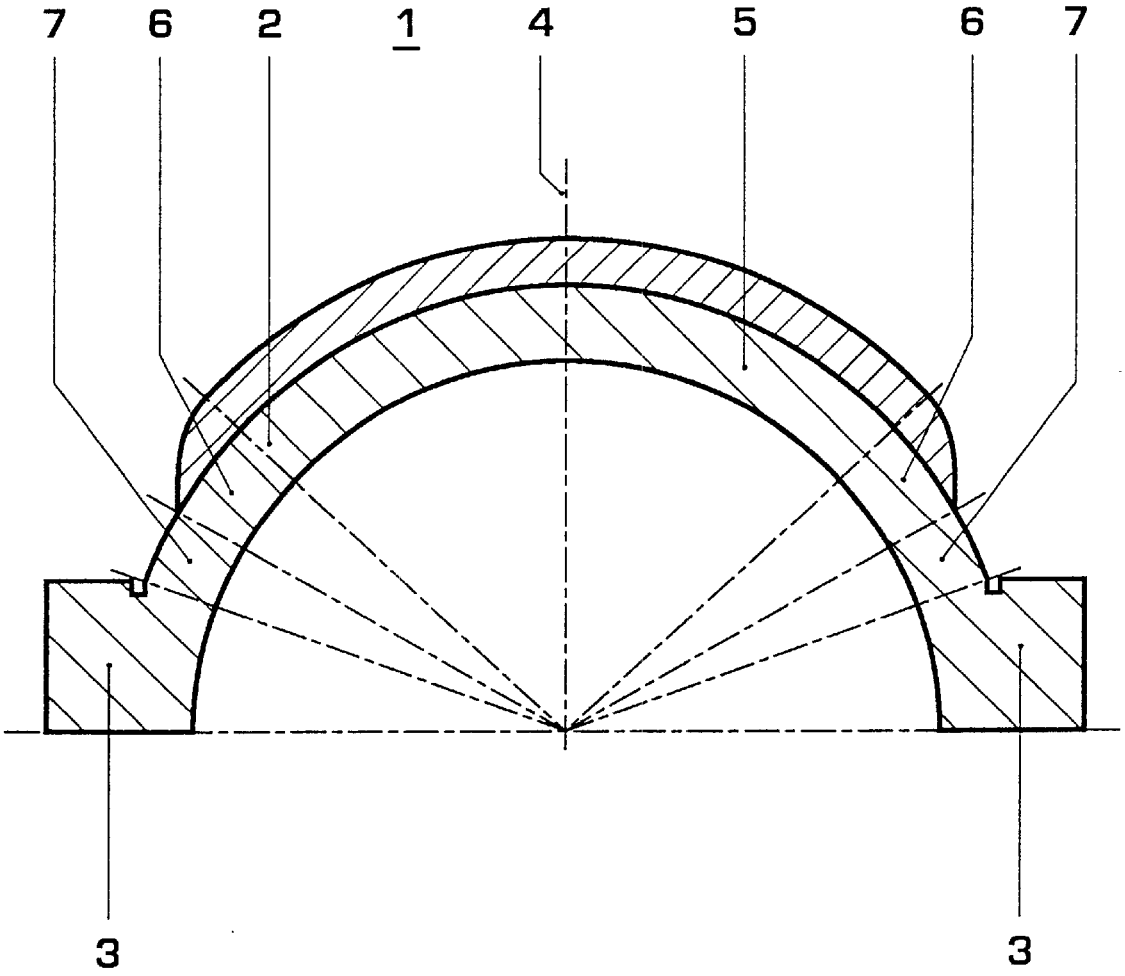
7
6
2
1
4
5
6
7
3
3

CASING FOR A STEAM OR GAS TURBINE

TECHNICAL FIELD

The invention relates to a casing for a steam or gas turbine, which comprises a shell and two flanges.

PRIOR ART

Compressor casings for gas turbines are known, which comprise a shell and two flanges. These casing have a pseudo-flange in the upper and lower region of the shell. These, however, have the disadvantage that increased radial expansion occurs in the region of the pseudo-flange during operating of the gas turbine owing to the higher mean temperature, and the casing thus changes from its round shape. This deformation leads to reduced efficiency, since the gap between the casing and the ends of the turbine blades is enlarged, and steam or air can flow through without any impediment at this point, without carrying out any work on the turbine.

Casings for steam turbines are also known, which comprise a shell and two flanges and which have vertical slits in the horizontal flanges. However, owing to the temperature distribution in the shell and the flanges, this leads to the shell being subjected to severe deformation as a result of the solid flanges being attached by screws. This deformation acts on the casing both radially and axially. Radially, an ellipsoid shape is produced from the round shell shape, since the shell expands upwards and the two flanges are moved slightly inwards. Axially, the radial effects have different effects within the casing owing to the different temperature distribution, and thus likewise lead to deformation. Owing to the necessary increased radial clearance between the casing and the ends of the turbine blades, this deformation leads to poorer efficiency, since steam can increasingly flow through, without carrying out any work on the turbine. The slits which the separating flanges have reduce in particular the axial deformation of the casing but, on their own, are not sufficient to prevent the radial deformation, and thus the reduced efficiency.

Furthermore, designs are known which use shrinking rings to prevent the deformation of a steam turbine casing. However, these designs have the disadvantage that they are very expensive and special assembly jigs are required for this purpose.

DESCRIPTION OF THE INVENTION

The object of the invention is to design a casing for a steam or gas turbine, which retains its round shape in operation or exhibits only relatively minor deformation, in order in this way to reduce the radial clearance between the casing and the ends of the turbine blades and to prevent the poorer efficiency associated with this. Furthermore, it is intended to avoid expensive designs and assembly jigs.

This object is achieved according to the invention in that the shell has different wall thicknesses in the upper region facing away from the flanges, in two central regions and in two lower regions facing the flanges, in which case the wall thickness of the upper region facing away from the flanges is reinforced in comparison with the wall thickness of the lower regions facing the flanges, and the wall thickness of the central regions is variable such that the upper region facing away from the flanges and the lower regions facing the flanges merge continuously into one another.

One advantage of this invention is that variation of the wall thickness of the shell of the casing considerably reduces deformation into an ellipsoid shape, both in the radial direction and in the axial direction. The casing thus has little radial clearance between the casing and the ends of the turbine blades and, in consequence, has considerably better efficiency than the prior art. Overall, the invention achieves an improvement in the steam turbine efficiency of 0.2% to 0.3%.

Further refinement options of the invention are the subject matter of the dependent claims.

BRIEF DESCRIPTION OF THE DRAWING

The single FIGURE shows a section through one embodiment of a casing according to the invention.

IMPLEMENTATION OF THE INVENTION

The single FIGURE shows a section through one embodiment of a casing 1 according to the invention, which is used for steam or gas turbines. The entire casing comprises two identical halves, only one of which is shown. The casing 1 comprises a shell 2 and two flanges 3, which are used for attachment to the flanges of the second half (which is not shown) of the casing 1. The wall thickness of the shell 2 varies in different regions. An upper region 5 facing away from the flanges is reinforced in comparison with the lower regions 7 facing the flanges. In the illustrated embodiment, the wall thickness of the upper region 5 facing away from the flanges correspond to 1.5 times the wall thickness of the lower regions 7 facing the flanges. The extent to which the upper region is reinforced may, however, differ and depends on the design of the turbine, and thus on the operating pressure and on the operating temperature. However, it has been found that the reinforcement of the upper region 5 facing away from the flanges should be not more than twice the wall thickness of the lower regions 7 facing the flanges. The upper region 5 facing away from the flanges, and the lower regions 7 facing the flanges, are connected by a central region 6 on each side. The wall thickness of the central regions 6 varies, so that two adjacent regions 5,7 merge continuously into one another on each side. In the illustrated exemplary embodiment, it is advantageous for the upper region 5 facing away from the flanges to be arranged at 45° to the center axis 4 of the casing 1. The central region 6 is connected to this on both sides, at 15°. However, other angles are also feasible in order that the design provides the effect according to the invention. Since the central regions 6 and, in particular, the upper region 5 facing away from the flanges are stiffer, due to the greater wall thickness, than the unreinforced lower regions 7 facing the flanges, less deformation can occur as a result of the temperature distribution during operation. The lower regions 7 facing the flanges can deform more and act like a joint which acts in a compensating manner between the flanges 3, which are machined to be very solid and are attached by screws, and the partially reinforced central regions 6 as well as the reinforced upper region 5 facing away from the flanges. Overall, this leads to reduced radial and axial deformation of the casing 1, and the casing 1 thus remains considerably more round during operation of the turbine. Reduced radial clearance between the casing 1 and the ends of the turbine blades (which are not shown) considerably increases the efficiency.

LIST OF REFERENCE SYMBOLS

1 Casing
2 shell
3 flange
4 center axis

5 upper region
6 central regions
7 lower regions

What is claimed is:

1. Casing for a steam or gas turbine, comprising:

a shell and two flanges, wherein the shell has different wall thicknesses in the upper region facing away from the flanges, in two central regions and in two lower regions facing the flanges, in which case the wall thickness of the upper region facing away from the flanges is reinforced in comparison with the wall thickness of the lower regions facing the flanges, and the wall thickness of the central regions is variable.

2. Casing according to claim 1, wherein the upper region facing away from the flanges is arranged at an angle of 45° to the center axis of the casing, and the central regions are connecting to it at an angle of 15°.

3. Casing according to claim 1, wherein the wall thickness of the upper region facing away from the flanges has a maximum of twice the wall thickness of the lower regions facing away from the flanges.

4. Casing according to claim 3, wherein the wall thickness of the upper region facing away from the flanges has 1.5 times the wall thickness of the lower regions facing away from the flanges.

* * * * *